US010191402B2

(12) United States Patent
Furukawa

(10) Patent No.: US 10,191,402 B2
(45) Date of Patent: Jan. 29, 2019

(54) METHOD FOR FORMING DEVELOPER COMPOSED WITH MOTHER PARTICLES CONTAINING EXTERNAL ADDITIVE

(71) Applicant: Oki Data Corporation, Tokyo (JP)

(72) Inventor: Yuichi Furukawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/436,121

(22) Filed: Feb. 17, 2017

(65) Prior Publication Data

US 2017/0248862 A1 Aug. 31, 2017

(30) Foreign Application Priority Data

Feb. 29, 2016 (JP) ..... 2016-036716

(51) Int. Cl.
*G03G 9/097* (2006.01)
*G03G 15/01* (2006.01)

(52) U.S. Cl.
CPC ..... *G03G 15/0126* (2013.01)

(58) Field of Classification Search
CPC ..... G03G 9/09725; G03G 9/09733
See application file for complete search history.

(56) References Cited

U.S. PATENT DOCUMENTS

2003/0073017 A1* 4/2003 Fields ..... G03G 9/08755 430/108.1
2013/0196261 A1* 8/2013 Uchinokura ..... G03G 9/08 430/105
2015/0234302 A1* 8/2015 Kumai ..... G03G 9/08724 430/105

FOREIGN PATENT DOCUMENTS

JP 2008-250359 A 10/2008
JP 2012-103573 A 5/2012
JP 5737556 B2 6/2015

* cited by examiner

*Primary Examiner* — Peter L Vajda
(74) *Attorney, Agent, or Firm* — Muncy, Geissler, Olds & Lowe, P.C.

(57) ABSTRACT

An image forming apparatus for developing an image with developer includes a development part, a transfer part, and a fuser the medium. The developer is configured with a plurality of particles, an average circularity degree of the developer is ranged within 0.955 to 0.970, and a peeling rate (%) of the external additive by a following equation is 30.6% or less, $$\text{peeling rate (\%)}=[1-(X/Y)]\times 100 \quad (1)$$

wherein X is an amount (weight %) of the external additive included in the developer after ultrasonic waves are applied, and Y is an amount (weight %) of the external additive included in the developer before the ultrasonic waves are applied.

7 Claims, 2 Drawing Sheets

METHOD FOR FORMING DEVELOPER COMPOSED WITH MOTHER PARTICLES CONTAINING EXTERNAL ADDITIVE

CROSS REFERENCE TO RELATED APPLICATION

This application is related to, claims priorities from, and incorporate by reference Japanese Patent Application No. 2016-036716 filed on Feb. 29, 2016. This application is related to and incorporates by reference a co-pending US patent application entitled IMAGE FORMING APPARATUS, filed on the same day as this application, claiming the priority from Japanese Patent Application No. 2016-036717.

TECHNICAL FIELD

The present invention relates to an image forming apparatus for forming an image using developer including an external additive.

BACKGROUND

An electrographic image forming apparatus is widely used. Compared to an image forming apparatus of other systems, such as an inkjet system, a high quality image can be obtained in a short time.

In an image forming apparatus, an image is formed on a surface of a medium such as paper. In the image forming step, after an electrostatic latent image is adhered to a surface of a photosensitive drum, developer is adhered to the electrostatic latent image. Since the developer adhered to the electrostatic latent image is transferred to the surface of the medium and then heated and pressured, it is fused to the medium.

Developer includes an external additive as well as a coloring agent. The external additive functions to suppress agglomeration of developers.

Since a configuration of developer affects quality of an image, various considerations have been made relating to the configuration of the developer. Specifically, to improve the transferability, etc., of the developer, in cases where an external additive is fused to a mother particle, the average circularity degree of the mother particle is optimized (For example, see Patent Document 1).

RELATED ART

[Patent Doc. 1] JP Laid-Open Patent Publication 2008-250359

Although specific considerations are made relating to a configuration of developer, since quality of an image formed using developer is not satisfactory yet, there is room for improvement.

The present invention was made in view of the aforementioned problems, and aims to provide an image forming apparatus capable of obtaining a high quality image.

SUMMARY

An image forming apparatus, disclosed in the application, for developing a electrostatic latent image with developer including an external additive, including a development part that attaches the developer to the electrostatic latent image, a transfer part that transfers the developer attached to the electrostatic latent image to a medium, and a fuser that fuses the developer on the medium. Wherein the developer is configured with a plurality of particles, an average circularity degree of the developer is ranged within 0.955 to 0.970, and a peeling rate (%) of the external additive calculated by a following formula (1) is 30.6% or less, being calculated when ultrasonic waves are applied to a polyoxyethylene lauryl ether solution in which the developer is dispersed.

$$\text{peeling rate (\%)}=[1-(X/Y)]\times 100 \quad (1)$$

wherein X is an amount (weight %) of the external additive included in the developer after the ultrasonic waves are applied, Y is an amount (weight %) of the external additive included in the developer before the ultrasonic waves are applied, the polyoxyethylene lauryl ether solution is set such that a density=5% and a temperature=32° C., and the application of the ultrasonic waves is set such that strength=40 kHz and time=10 minutes.

The aforementioned "polyoxyethylene lauryl ether solution" is a solution including polyoxyethylene lauryl ether (PLE), which is an ether-type nonionic surfactant, and specifically, EMULGEN 109P (product name) manufactured by Kao Corporation. To disperse the first developer or the second developer in the PLE solution, 5 parts by weight of the developer is added to 100 parts by weight of a PLE solution, and the PLE solution in which the developer is added is stirred for three hours or more. However, the value of the first peeling rate calculated using the formula (1) is a value rounded off the second decimal place.

According to the image forming apparatus according to one embodiment of the present invention, since a peeling rate of an external additive relating to developer is 30.6% or less, a high quality image can be obtained.

DETAILED DESCRIPTION OF THE PREFERRED EMBODIMENT(S)

Hereinafter, an embodiment of the present invention will be described in detail with reference to the drawings. The order of the descriptions is as follows:

1. Image Forming Apparatus
   - 1-1. Overall Configuration
   - 1-2. Detail Configuration of Development Part
   - 1-3. Configuration and Manufacturing Method of Developer
   - 1-4. Operations
   - 1-5. Functions and Effects
2. Modified Example

1. Image Forming Apparatus

The image forming apparatus of one embodiment of the present invention will be described.

The image forming apparatus described herein is, for example, a full-color electrographic printer, and forms an image on a surface of a medium M. The material of the medium M is not especially limited, but, for example, it is any one, two or more types of paper, a film, etc.

<1-1. Overall Structure>

Figure 1:
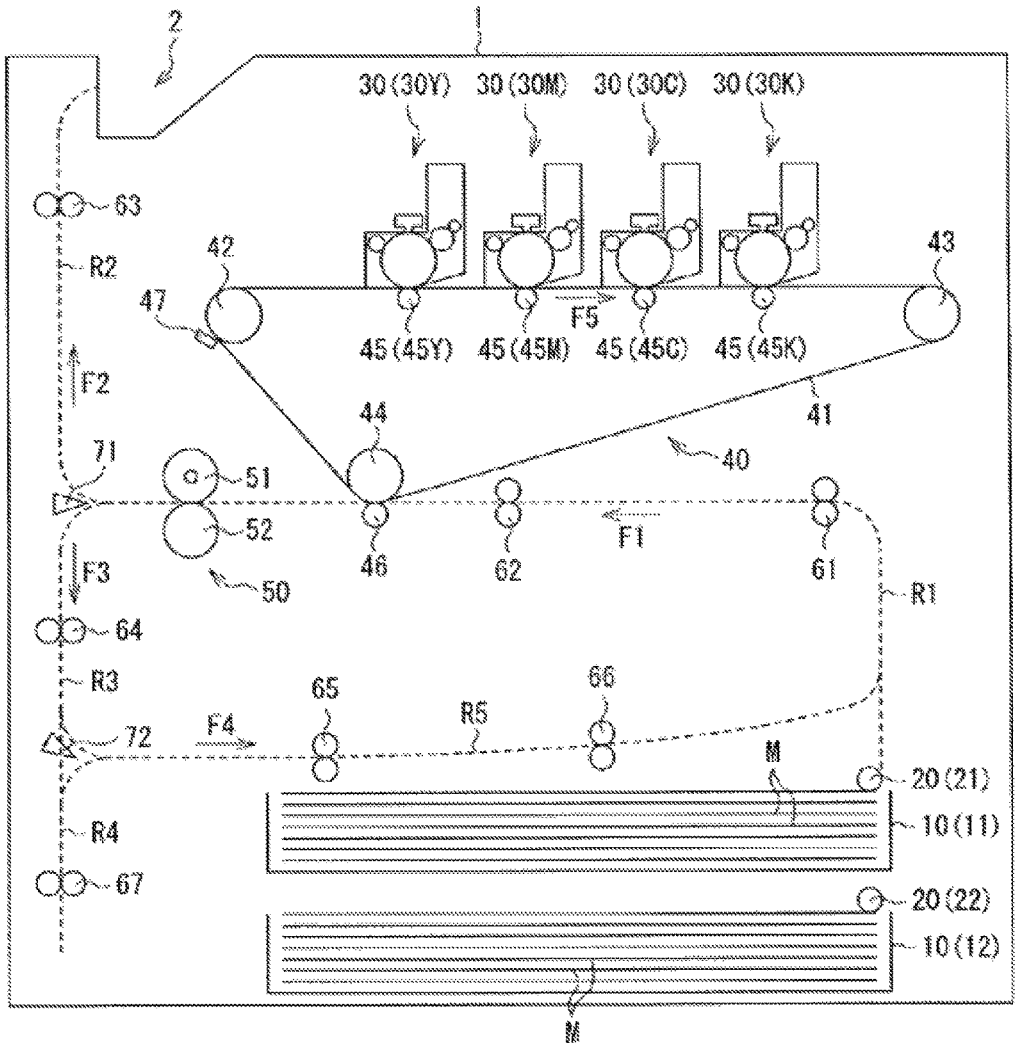
FIG. 1 is a view showing a planar configuration of an image forming apparatus according to one embodiment of the present invention.

Initially, the overall structure of the image forming apparatus will be described. FIG. 1 shows a configuration of the image forming apparatus in a plan view.

The image forming apparatus, as shown in FIG. 1, includes, for example, one, two or more trays 10, one, two or more send out rollers 20, one, two or more development parts 30, a transfer part 40, a fuser 50, carrying rollers 61 to 67, and carrying path switching guides 71 and 72 inside the housing 1.

Further, in the housing 1, a stacker part 2 is provided for ejecting a medium M in which an image is formed, and the medium M is carried along the carrying paths R1 to R5.

[Tray and Send Out Roller]

The tray 10 accommodates mediums M and is, for example, removably attached to the housing 1. In this tray 10, for example, a plurality of mediums M are accommodated in a stacked manner, and the plurality of mediums M are taken out one by one from the tray 10 by the send out roller 20.

Here, the image forming apparatus is equipped with, for example, two trays 10 (11, 12) and two send out rollers 20 (21, 22). The two trays 11 and 12 are, for example, arranged so as to overlap each other.

[Development Part]

The development part 30 performs a development process using developer (so-called toner). Specifically, the development part 30 forms an electrostatic latent image, as well as a developer image (so-called toner image) by making the developer adhere to the electrostatic latent image using a Coulomb force. The detailed configuration of the developer will be described later (see FIG. 3).

Here, the image forming apparatus is equipped with, for example, four development parts 30 (30Y, 30M, 30C, and 30K).

Each of the development parts 30Y, 30M, 30C, and 30K are, for example, removably attached to the housing 1 and arranged along the movement path of a later described intermediate transfer belt 41. Here, the development parts 30Y, 30M, 30C, and 30K are, for example, arranged in the movement direction of the intermediate transfer belt 41 from the upstream side to the downstream side in that order.

The development parts 30Y, 30M, 30C, and 30K have, for example, the same configuration except that the type of the developer accommodated in the later described cartridge 38 is different. Further, the detailed configuration of each of the development parts 30Y, 30M, 30C, and 30K will be described later.

[Transfer Part]

The transfer part 40 performs a transfer process using the developer which was subjected to a development process by the development part 30. Specifically, the transfer part 40 transfers the developer adhered to the electrostatic latent image by the development part 30 to the medium M.

The transfer part 40 includes, for example, an intermediate transfer belt 41, a drive roller 42, a driven roller (idler roller) 43, a backup roller 44, one, two or more primary transfer rollers 45, a secondary transfer roller 46, and a cleaning blade 47.

The intermediate transfer belt 41 is an intermediate transfer medium to which the developer is temporarily transferred before the developer is transferred to the medium M. The intermediate transfer belt 41 is, for example, an endless elastic belt, and includes any one type or two or more types of polymer compounds, such as polyimide. The intermediate transfer belt 41 is movable according to the rotation of the drive roller 42 in a state in which it is stretched by the drive roller 42, the driven roller 43, and the backup roller 44.

The drive roller 42 is rotatable in a clockwise direction via a drive source, such as a motor. The driven roller 43 and the backup roller 44 are each rotatable in the clockwise direction according to the rotation of the drive roller 42, similarly to the drive roller 42.

The primary transfer roller 45 transfers the developer supplied from the development part 30 to the intermediate transfer belt 41 (primary transfer). This primary transfer roller 45 is contacted and pressed to the development part 30 (later described photosensitive drum 31) via the intermediate transfer belt 41. The primary transfer roller 45 is rotatable in the clockwise direction according to the movement of the intermediate transfer belt 41.

Here, the transfer part 40 includes, for example, four primary transfer rollers 45 (45Y, 45M, 45C, and 45K) corresponding to the four development parts 30 (30Y, 30M, 30C, and 30K). Further, the transfer part 40 includes one secondary transfer roller 46 corresponding to one backup roller 44.

The secondary transfer roller 46 transfers (secondarily transfers) the developer transferred onto the intermediate transfer belt 41 to the medium M. This secondary transfer roller 46 is contacted and pressed against the backup roller 44 and includes, for example, a metallic core material and an elastic layer, such as a foamed rubber layer, covering the outer circumferential surface of the core material. The secondary transfer roller 46 is rotatable in the counterclockwise direction according to the movement of the intermediate transfer belt 41.

The cleaning blade 47 is contacted and pressed against the intermediate transfer belt 41 to scrape the unneeded developer remaining on the surface of the intermediate transfer belt 41.

[Fuser]

The fuser 50 performs a fusing process using the developer transferred to the medium M by the transfer part 40. Specifically, the fuser 50 fuses the developer to the medium M by applying heat to the developer transferred to the medium M by the transfer part 40 while applying a pressure.

The fuser 50 includes, for example, a heat application roller 51 and a pressure application roller 52.

The heat application roller 51 is a rotation body for heating the developer image and rotatable in the clockwise direction. The heat application roller 51 includes, for example, a hollow and cylindrical metallic core and a resin coat formed on the surface of the metallic core. The metallic core includes, for example, a metallic material, such as aluminum. The resin coats include, for example, a polymer compound, such as, e.g., a copolymer of tetrafluoroethylene and perfluoroalkyl vinyl ether (PFA) and polytetrafluoroethylene (PTFE).

Inside the heat application roller 51 (metallic core), for example, a heater, such as a halogen lamp, is arranged. The surface temperature of the heat application roller 51 is detected by, for example, a thermistor arranged at a position away from the heat application roller 51.

The pressure application roller 52 is a rotation body for applying pressure to the developer image and rotatable in the counterclockwise direction while being contacted and pressed to the heat application roller 51. The pressure application roller 52 is, for example, a metal rod. The metal rod includes, for example, a metallic material, such as aluminum.

[Carrying Roller]

Each of the carrying rollers 61 to 67 includes a pair of rollers arranged so as to face each other via the carrying paths R1 to R5 of the medium M, and carries the medium M taken out by the send out roller 20. Specifically, for example, when an image is formed only on one side of the medium M, the medium M is carried by the carrying rollers 61 to 63 along the carrying paths R1 and R2. Further, for example, when an image is formed on both sides of the medium M, the medium M is carried by the carrying rollers 61 to 67 along the carrying paths R1 and R5.

[Carrying Path Switching Guide]

The carrying path switching guides 71 and 72 switch the carrying direction of the medium M according to the condition, such as the pattern of the image to be formed on the medium M (whether the image is formed only on one side of the medium M or the image is formed on both sides of the medium M).

<1-2. Detailed Configuration of Development Part>

Figure 2:
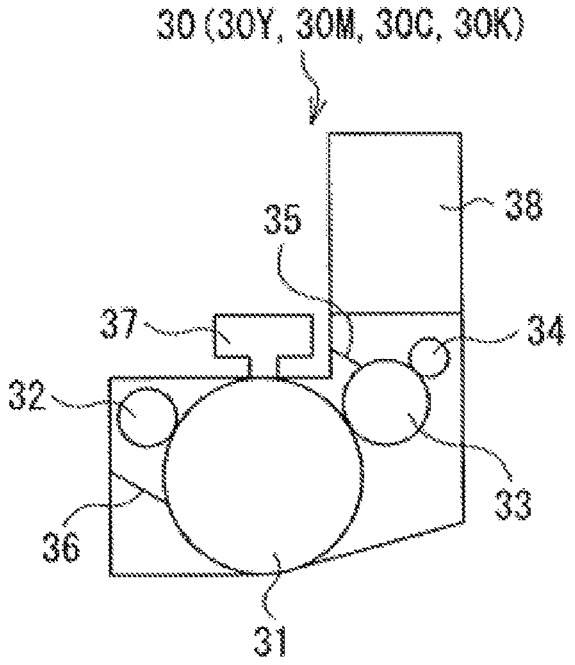
FIG. 2 is an enlarged plan view of the configuration of the developing unit shown in FIG. 1.

Next, the detailed configuration of the development part 30 shown in FIG. 1 will be described. FIG. 2 shows an enlarged configuration of the development part 30 in plan view.

The development parts 30Y, 30M, 30C, and 30K are, for example, as shown in FIG. 2, each includes a photosensitive drum 31, a charge roller 32, a development roller 33, a supply roller 34, a development blade 35, a cleaning blade 36, a light emitting diode (LED) head 37, and a cartridge 38.

The photosensitive drum 31 is, for example, an organic photosensitive body that includes a cylindrical conductive support and a photoconductive layer that covers the outer circumferential surface of the conductive support, and rotatable in a counterclockwise direction via a drive source, such as a motor. The conductive support is, for example, a metallic pipe including any one type or two or more types of metallic materials, such as aluminum. The photoconductive layer is, for example, a laminated body including a charge generation layer, a charge transportation layer, etc.

The charge roller 32 includes, for example, a metal shaft and a semiconductive epichlorohydrin rubber layer covering the outer circumferential surface of the metal shaft, and is rotatable in the clockwise direction. The charge roller 32 is contacted and pressed to the photosensitive drum 31 to charge the photosensitive drum 31.

The development roller 33 includes, for example, a metal sheet and a semiconductive urethane layer covering the outer circumference surface of the metal sheet, and is rotatable in the clockwise direction. This development roller 33 carries the developer supplied from the supply roller 34 and makes the developer adhere to the electrostatic latent image formed on the surface of the photosensitive drum 31.

The supply roller 34 includes, for example, a metal shaft and a semiconductive foamed silicon sponge layer covering the outer circumferential surface of the metal shaft, and is rotatable in the counterclockwise direction. The supply roller 34 supplies the developer to the surface of the photosensitive drum 31 while sliding on the development roller 33.

The development blade 35 regulates the thickness of the developer supplied to the surface of the supply roller 34. The development blade 35 is arranged, for example, at a position away from the development roller 33 by a predetermined distance, and the thickness of the developer is controlled based on the gap between the development roller 33 and the development blade 35. Further, the development blade 35 includes, for example, any one type or two or more types of metallic materials, such as stainless steel.

The cleaning blade 36 scrapes the unneeded developer remaining on the surface of the photosensitive drum 31. This cleaning blade 36 extends, for example, in a direction approximately parallel to the extending direction of the photosensitive drum 31 and is contacted and pressed to the photosensitive drum 31. Further, the cleaning blade 36 includes, for example, any one type or two or more types of polymer compounds, such as urethane rubber.

The LED head 37 is an exposure device for forming an electrostatic latent image on the surface of the photosensitive drum 31 by exposing the surface of the photosensitive drum 31, and includes, for example, an LED element, a lens array, etc. The LED element and the lens array are arranged so that the light (irradiation light) output from the LED element forms an image on the surface of the photosensitive drum 31.

The cartridge 38 is, for example, removably attached to the development part 30, and contains the developer. The color of the developer contained in the cartridge 38 is, for example, as follows. In the cartridge 38 of the development part 30Y, for example, a yellow developer is contained. In the cartridge 38 of the development part 30M, for example, a magenta developer is contained. In the cartridge 38 of the development part 30C, for example, a cyan developer is contained. In the cartridge 38 of the development part 30K, for example, a black developer is contained.

<1-3. Configuration and Manufacturing Method of Developer>

Figure 3:
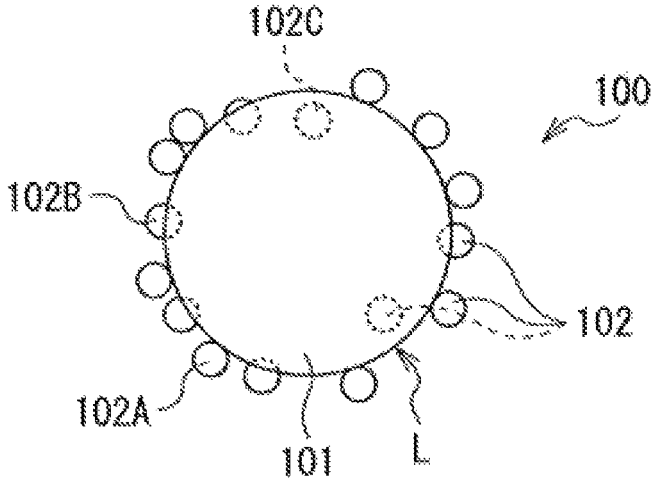
FIG. 3 is a view schematically showing the configuration of the developer.

Next, the configuration and the manufacturing method of the developer will be described. FIG. 3 schematically shows the cross-sectional configuration of the developer 100, which is the developer used in the aforementioned image forming apparatus.

The developer 100 described herein is, for example, developer of a single component development system, and more specifically a negatively chargeable developer.

A single component development system denotes a system for applying an appropriate charge amount to the developer itself without using a carrier (magnetic particles) for applying an electric charge to the developer. On the other hand, a two component development system denotes a system for applying an appropriate charge amount to the developer using the friction between the carrier and the developer by mixing the aforementioned carrier and the developer.

Since the developer 100, which is developer of a single component development system, is a negatively chargeable developer as described above, a negative charge amount is applied to the developer 100. The saturated charge amount of the developer 100 as a negative developer is not especially limited, but is, for example, −50 μC/g to −10 μC/g.

Further, the color of the developer 100 is not especially limited. That is, the developer 100 may be a yellow developer used in the development part 30Y, a magenta developer used in the development part 30M, a cyan developer used in the development part 30C, or a black developer used in the development part 30K.

[Configuration of Developer]

The developer 100 is, for example, a plurality of particles. Each of the plurality of particulate developers 100 includes, as shown in FIG. 3, external additives 102.

More specifically, the developer 100 includes a mother particle 101 and external additives 102 fused to the mother particle 101, and the external additives 102 are a plurality of particles. That is, the plurality of particulate developers 100 include a plurality of mother particles 101 and a plurality of particulate external additives 102 fused to each mother particle 101.

Each of the mother particles function as a core of a piece of the developer. In the embodiment, the mother particles are illustrated as a single piece (or a mono structure) in FIG. 3. The mother particle, however, may be formed with multiple pieces. The external additives 102 are fused to the mother particles such that some of the additives are attached on the surfaces of the mother particles and some of the additives are embedded in the mother particles.

The mother particle 101 includes, for example, a coloring agent. However, the mother particle 101 may include any one type or two or more types of other materials along with the coloring agent.

The coloring agent mainly colors an image formed using the developer 100. The coloring agent includes any one type or two or more types of an arbitrary color pigment, an arbitrary color dye (pigment), etc. Each of the colors of the pigment and the dye is determined according to the color of the developer 100 in which the coloring agent is used.

The yellow pigment is, for example, pigment yellow 74, etc. The magenta pigment is, for example, quinacridone, etc. The cyan pigment is, for example, phthalocyanine blue (C.I. Pigment Blue 15:3), etc. The black pigment is, for example, carbon, etc.

The yellow pigment is, for example, C.I. pigment yellow 74, cadmium yellow, etc. The magenta pigment is, for example, C.I. pigment red 238, etc. The cyan pigment is, for example, pigment blue 15:3, etc. The black pigment is, for example, carbon black, etc., and the carbon black is, for example, furnace black, channel black, etc.

Further, the content rate of the coloring agent in the developer 100 is not especially limited, but is, for example, 2 parts by weight to 25 parts by weight to the content rate of the later described binding agent (100 parts by weight), and preferably 2 parts by weight to 15 parts by weight.

The type of the other materials is not especially limited, but is, for example, a binding agent, a release agent, and a charge control agent.

The binding agent mainly binds the coloring agent, etc. The binding agent includes, for example, any one type or two or more types of polymer compounds, such as, e.g., a polyester based resin, a styrene-acrylic based resin, an epoxy based resin, and a styrene-butadiene based resin.

Among them, the binding agent preferably includes a polyester based resin. Since the polyester based resin has a high affinity to the medium M such as a paper, the developer 100 including a polyester based resin as the binding agent can easily fuse to the medium M. Further, since the polyester based resin has a high physical strength even when the molecular weight is comparatively small, the developer including the polyester based resin as the binding agent has excellent durability.

The polyester based resin is, for example, a reactant (condensation polymer) of one or two or more alcohols and one or two or more carboxylic acids.

The type of alcohol is not especially limited, but among them, dihydric or higher alcohol or its derivative is preferable. The dihydric or higher alcohol is exemplified by, for example, ethylene glycol, diethylene glycol, triethylene glycol, polyethylene glycol, propylene glycol, butanediol, pentanediol, hexanediol, cyclohexane dimethanol, xylene glycol, dipropylene glycol, polypropylene glycol, bisphenol A, hydrogenated bisphenol A, bisphenol A ethylene oxide, bisphenol A propylene oxide, sorbitol, and glycerin.

The type of carboxylic acid is not especially limited, but among them, a bivalent or higher carboxylic acid or its derivative is preferable. The bivalent or higher carboxylic acid is exemplified by, for example, maleic acid, fumaric acid, phthalic acid, isophthalic acid, terephthalic acid, succinic acid, adipic acid, trimellitic acid, pyromellitic acid, cyclopentane dicarboxylic acid, succinic anhydride, trimellitic anhydride, maleic anhydride, and dodecenyl succinic anhydride acid.

The type the polyester based resin (crystal condition) is not especially limited. Therefore, the polyester based resin may be a crystalline polyester based resin, an amorphous polyester based resin, or both. Among them, it is preferable that the type of the polyester based resin be crystalline polyester. That is because the developer 100 becomes more easily fusible by the medium M and the durability of the developer 100 further improves.

To investigate whether or not the developer 100 (mother particle 101) includes crystalline polyester as a binding agent, the developer 100 may be, for example, analyzed using a differential scanning calorimetric measurement system (DSC). When developer 100 including crystalline polyester as a binding agent is analyzed using the differential scanning calorimetric measurement system twice continuously, an endothermic peak is detected within a range of 30° C. to 70° C. in the first measurement result, and an endothermic peak is not detected within the range of 30° C. to 70° C. in the second measurement result.

The release agent mainly improves the fusing property and the offset resistance of the developer 100. The release agent includes one type or two or more types of waxes, such as, e.g., an aliphatic hydrocarbon based wax, oxides of an aliphatic hydrocarbon based wax, an aliphatic ester based wax, and a deoxidized aliphatic ester based wax. Further, the release agent may be, for example, a block copolymers of the aforementioned series of waxes.

The aliphatic hydrocarbon based wax is exemplified by, for example, low molecular weight polyethylene, low molecular weight polypropylene, olefin copolymer, a microcrystalline wax, a paraffin wax, and a Fischer-Tropsch wax. The oxide of the aliphatic hydrocarbon based wax is, for example, a polyethylene oxide wax, etc. The aliphatic ester based wax is, for example, a carnauba wax, a montan acid ester wax, etc. The deoxidized aliphatic ester based wax is a wax in which a part or all of the aliphatic ester based wax is deoxidized, and is, for example, a deoxidation carnauba wax.

Further, the content rate of the release agent in the developer 100 is not especially limited, but is, for example, 0.1 parts by weight to 20 parts by weight to the content rate of the binding agent (100 parts by weight), preferably 0.5 parts by weight to 12 parts by weight.

The charge control agent mainly regulates the frictional changeability of the developer 100, etc. The charge control agent used in the developer 100 as a negatively chargeable developer includes, for example, any one type or two or more types of an azo based complex, a salicylate based complex, a calixarene based complex, etc.

Further, the content rate of the charge control agent in the developer 100 is not especially limited, but is, for example, 0.05 parts by weight to 15 parts by weight to the content amount (100 parts by weight) of the binding agent, preferably 0.1 parts by weight to 10 parts by weight.

The external additive 102 mainly improves the flowability of the developer 100 by suppressing the agglomeration of the developer 100 (mother particles 101) to each other. However, the external additive 102 also functions to improve, for example, the environmental stability, the charging stability, the developability, the preservability, the cleanability, etc., of the developer 100.

The external additives 102 are, as described above, a plurality of particles and fused to the mother particle 101. Therefore, the plurality of particulate external additives 102 exists on the surface of the mother particle 101 and its vicinity while being fixed to the mother particle 101.

To make it easy for the plurality of particulate external additive 102 to exist on the surface of the mother particle 101 and its vicinity, the mean particle diameter of the plurality of particulate external additives 102 is smaller than the mean particle diameter of the plurality of mother particles 101. However, the "mean particle diameter" described relating to the present invention is the so-called median size (D50:μm) and will be the same hereinafter.

The mean particle diameter of the plurality of particulate external additive 102 is not especially limited as long as it is set to be smaller than the mean particle diameter of the plurality of mother particles 101. Therefore, the mean particle diameter of the plurality of particulate external additives 102 may be arbitrarily set. In this case, two or more types of external additives 102 having different mean particle diameters from each other may be used together.

The external additive 102 includes, for example, any one type or two or more types of inorganic materials, organic materials, etc. The inorganic material is, for example, a hydrophobic silica, etc. The organic material is, for example, a melamine resin, etc.

In this developer 100, for example, by improving the fusing property of the external additive 102 to the mother particle 101, the external additive 102 is suppressed from peeling (falling off) from the mother particle 101 at the time of forming an image. Along with this, it is preferable that a part or all of the plurality of particulate external additives 102 be partially or entirely entered in the mother particle 101.

The aforementioned "partially or entirely entered in the mother particle 101" means that a part or all of the external additive 102 is positioned inside the outline L (inside the mother particle 101) when focusing on the outline (outer edge) L of the mother particle 101.

Specifically, the plurality of particulate external additive 102 includes, for example, external additives 102A to 102C in three types of conditions. However, the external additives 102 may include all of the external additives 102A to 102C, or include only a part of the external additives 102A to 102C. More specifically, the external additives 102, for example, may include the external additives 102A and only the external additives 102B, may include the external additive 102A and only the external additive 102C, or may include the external additive 102A and both the external additives 102B and 102C.

The external additive 102A exists on the surface of the mother particle 101, and the entirety of the external additive 102A is positioned outside of the outline L of the mother particle 101. With this, since the external additive 102A is not entered inside the mother particle 101, the external additive 102A is more weakly held by the mother particle 101.

The external additive 102B exists in the vicinity of the surface of the mother particle 101, and a part of the external additive 102B is positioned inside of the outline L of the mother particle 101. With this, since a part of the external additive 102B is entered inside the mother particle 101, the external additive 102B is more strongly held by the mother particle 101.

The external additive 102C exists in the vicinity of the surface of the mother particle 101, and the entirety of the external additive 102C is positioned inside of the outline L of the mother particle 101. With this, since the entirety of the external additive 102C is entered inside the mother particle 101, the external additive 102C is significantly more strongly held by the mother particle 101.

As it is apparent from the comparison of the existential state of the external additives 102A to 102C, since the fusing property of the mother particle 101 is higher in the order of 102A to 102C, the external additives 102A to 102C are less likely to peel from the mother particle 101 in that order.

That is, since the external additive 102A is more weakly held by the mother particle 101, the external additive 102A has a tendency to peel from the mother particle 101 when repeating forming steps of images. Since the external additive 102B is more strongly held by the mother particle 101, the external additive 102B has a tendency to unlikely to peel from the mother particle 101 in comparison to the external additive 102A even when repeating the image forming steps. Since the external additive 102C is significantly strongly held by the mother particle 101, the external additive 102C has a tendency to unlikely peel from the mother particle 101 in comparison to the external additive 102B even when repeating the image forming steps.

Therefore, when the external additive 102 includes one or both of the external additives 102B and 102C, in comparison to the case in which the external additive 102 does not include one or both of the external additives 102B and 102C, the external additive 102 is less likely to peel from the mother particle 101 at the time of image forming. In this way, the tendency in which the external additive 102 is less likely to peel from the mother particle 101 becomes more significant as the ratio of each of the external additives 102B and 102C in the external additive 102 becomes larger.

To check whether a portion or the entirety of the plurality of particulate external additives 102 is partially or entirely entered inside the mother particle 101, that is, to check whether the external additive 102 includes one or both of the external additives 102B and 102C, the developer 100 may be observed, for example, using a microscope, such as a scanning electron microscope (SEM), etc.

The shape of the developer 100 is not especially limited, but it is preferably as close as possible to a sphere. That is because the transferability of the developer 100 improves, thereby improving the quality of the image. Further, FIG. 3 shows a case in which the planar shape (outline) of the developer 100 is circular.

More specifically, the average circularity degree of the plurality of particulate developers 100 is not especially limited, but among them, 0.955 to 0.970 is preferable. That is because the quality of the image improves sufficiently.

Further, the content rate of the external additives 102 in the developer 100 is not especially limited, but is, for example, 0.01 parts by weight to 10 parts by weight to the content rate of the binding agent (100 parts by weight), preferably 0.05 parts by weight to 8 parts by weight.

In such a case where the circularity degree and the particle diameter are high (or large), to adjust the fluidity of the developer 100, as needed, an additional external additive 102 having a comparatively large mean particle diameter (D50) may be used. The additional external additive 102 includes, for example, one type or two or more types of the aforementioned inorganic particles, etc., and the mean particle diameter of the additional external additive 102 is, for example, 50 nm or more. Further, the content rate of the release agent in the external additive 102 in the developer 100 is not especially limited, but is, for example, 0.5 parts by weight to 3 parts by weight to the content rate of the binding agent (100 parts by weight).

[Physical Properties of Developer]

In the developer 100, to suppress occurrence of scraping phenomenon at the time of forming an image, the fusing condition of the external additive 102 to the mother particle 101 is optimized. The scraping phenomenon is a defect that deteriorates quality of an image and the details of the scraping phenomenon will be described later.

Specifically, the peeling rate (%) of the external additive 102 calculated by the following formula (1) when applying ultrasonic waves to a dispersed polyoxyethylene lauryl ether solution (PLE) in which the developer 100 is dispersed is 30.6% or less, preferably 25.6% or less.

$$\text{Peeling rate } (\%)=[1-(X/Y)]\times 100 \quad (1)$$

(X is an amount (weight %) of the external additive 102 included in the developer 100 after applying ultrasonic waves. Y is an amount (weight %) of the external additive 102 included in the developer 100 before applying ultrasonic waves)

However, the PLE solution is, as described above, a solution including PLE, which is an ether-type nonionic surfactant, and specifically, EMULGEN 109P (product name) manufactured by Kao Corporation. The conditions relating to the PLE solution are set such that density=5% and temperature=32° C. The conditions relating the application of ultrasonic waves are set such that the strength (wavelength)=40 kHz and the time=10 minutes.

Further, to disperse the developer 100 in the PLE solution, 5 parts by weight of developer 100 is added to 100 parts by weight of a PLE solution. In addition, after adding the developer 100 to the PLE solution, the PLE solution is stirred for three hours or more.

The "peeling rate" is an index showing the amount of the external additive 102 that has peeled from the mother particle 101 caused by the application of ultrasonic waves, as it is apparent from the aforementioned formula (1). That is, a small peeling rate means that the amount of the external additives 102 that have peeled from the mother particle 101 caused by the application of ultrasonic waves is small. On the other hand, a large peeling rate means that the amount of the external additives 102 that have peeled from the mother particle 101 caused by the application of ultrasonic waves is large. However, the value of the peeling rate calculated using the formula (1) is a value rounded off to the second decimal place.

As it is apparent from the aforementioned peeling rate condition (30.6% or less), in the developer 100, the peeling rate is controlled to be sufficiently small. The peeling rate condition is considered to be satisfied mainly by the presence of the aforementioned external additives 102B and 102C. That is, the external additives 102B and 102C held by the mother particle 101 is less likely to peel from the mother particle 101 even when ultrasonic waves are applied to the developer 100, so the amount of peeling of the external additives 102B and 102C from the mother particle 101 is suppressed to be sufficiently small.

[Manufacturing Method of Developer]

The developer 100 is manufactured, for example, by the following processes.

The manufacturing method of the developer 100 is not especially limited. That is, the developer 100 may be, for example, manufactured by using a pulverization method, manufactured by using a polymerization method, or manufactured by other methods. Of course, two or more types of the aforementioned manufacturing methods may be used in combination to manufacture the developer 100. The polymerization method is, for example, a dissolution suspension method, etc.

Here, for example, a case in which the developer 100 is manufactured using a pulverization method will be described.

When manufacturing the developer 100, initially, a mixture is obtained by mixing a coloring agent and other materials, such as a binding agent, as necessary.

Next, after kneading the mixture while melting, the mixture after the melt-kneading is cooled to thereby obtain a precursor. In that case, as a device for melt-kneading, for example, any one type or two or more types of an extruder, a biaxial kneading device, etc., is used. The precursor is an ingot of the mother particle 101 including the aforementioned coloring agent, etc.

Next, by classifying the pulverized precursor after pulverizing the precursor, a plurality of mother particles 101 is obtained. The number of the pulverization process may by one, or two or more. When the number of the pulverization process is two or more, one or more coarse grinding processes and one or more fine grinding processes may be performed. In this case, as a pulverization device, for example, any one type or two or more types among a cutter mill, a jet mill, a collision pulverization device, etc., is used. As a device for classification, for example, any one type or two or more types of an air-classifier, etc., is used.

Particularly, when pulverizing a precursor, by adding an external additive 102 to the precursor to perform the pre-external addition process, the precursor is pulverized in a state in which the precursor coexists with the external additive 102. The addition amount of the external additive 102 is set to a part of an amount W1 of the total amount W of the external additive 102 to be ultimately included (after the completion of the manufacturing of the developer 100) in the developer 100 (W1<W). In the pre-external addition process, since the external additive 102 is added to the precursor while the precursor is being pulverized, the external additive 102 is fused to the mother particle 101 and a part of the external additive 102 (external additives 102B and 102C) enters inside the mother particle 101. Therefore, in the pre-external addition process, mainly the external additives 102B and 102C among the aforementioned external additives 102A to 102C become likely to be formed.

Finally, to perform a post-external addition process, after the external additives 102 are added to the mother particle 101, the mother particle 101 is stirred in a state in which it coexists with the external additives 102. The addition amount of the external additives 102 is the remaining amount W2 of the total amount W of the external additives 102 to be ultimately included in the developer 100 (=W−W1). In this case, as a post-external addition device, for example, any one type or two or more types of a Henschel mixer, etc., is used. In the post-external addition process, the external additives 102 are fused to the mother particle 101. Therefore, in the post-external addition process, mainly the external additive 102A among the aforementioned external additives 102A to 102C becomes likely to be formed.

With this, the developer 100 is obtained. When manufacturing this developer 100, for example, the aforementioned peeling rate may be controlled by adjusting the addition amount W1 of the external additive 102 in the pre-external addition process.

<1-4. Operation>

Next, the operation of the image forming apparatus will be described.

Here, with reference to FIG. 1 and FIG. 2, a case in which an image is formed on one side of the medium M will be described. In this case, the medium M accommodated in the tray 11 is used.

The image forming apparatus, as described hereinafter, for example, performs a development process, a transfer process, a fusing process, and a cleaning process.

[Development Process]

The medium M accommodated in the tray 11 is taken out by the send out roller 21. The medium M is carried by the carrying rollers 61 to 62 along the carrying path R1 in the direction of the arrow F1.

In the development process, in the development part 30Y, when the photosensitive drum 31 rotates, the charge roller 32 applies a direct current voltage on the surface of the photosensitive drum 31 while rotating. With this, the surface of the photosensitive drum 31 is evenly charged.

Next, according to an image signal, an LED head 37 irradiates light on the surface of the photosensitive drum 31. With this, since the surface potential attenuates (light attenuation) at the light irradiation portion on the surface of the photosensitive drum 31, an electrostatic latent image is formed on the surface of the photosensitive drum 31.

On the other hand, in the development part 30Y, a yellow developer accommodated in the cartridge 38 is released toward the supply roller 34.

After a voltage is applied to the supply roller 34, the supply roller 34 rotates. With this, a yellow developer is supplied to the surface of the supply roller 34 from the cartridge 38.

After a voltage is applied to the development roller 33, the development roller 33 rotates while being contacted and pressed by the supply roller 34. With this, since a yellow developer supplied to the surface of the supply roller 34 is absorbed on the surface of the development roller 33, the developer is carried by using the rotation of the development roller 33. In this case, since a part of the yellow developer absorbed on the surface of the development roller 33 is removed by the development blade 35, the thickness of the yellow developer absorbed on the surface of the development roller 33 is made even.

After the photosensitive drum 31 rotates while being contacted and pressed by the development roller 33, the yellow developer absorbed on the surface of the development roller 33 is transferred to the surface of the photosensitive drum 31. With this, since the yellow developer adheres to the surface of the photosensitive drum 31 (electrostatic latent image), a yellow developer image is formed.

[Primary Transfer Process]

In the transfer part 40, when the drive roller 42 rotates, the driven roller 43 and the backup roller 44 rotate in accordance with the rotation of the drive roller 42. With this, the intermediate transfer belt 41 moves in the direction of the arrow F5.

In the primary transfer process, a voltage is applied to the primary transfer roller 45Y. Since the primary transfer roller 45Y is contacted and pressed to the photosensitive drum 31 via the intermediate transfer belt 41, the yellow developer adhered to the surface of the photosensitive drum 31 (electrostatic latent image) in the development process is transferred to the intermediate transfer belt 41.

After this, the intermediate transfer belt 41 in which the yellow developer is transferred continues to move in the direction of the arrow F5. With this, in the development parts 30M, 30C, and 30K and the primary transfer rollers 45M, 45C, and 45K, the development process and the primary transfer process are performed in the same order by the same procedures as the aforementioned development part 30Y and the primary transfer roller 45Y. Therefore, since the developer of each color (magenta, cyan, and black) is sequentially transferred to the intermediate transfer belt 41, the developer image of each color is formed.

That is, since the magenta developer is transferred onto the surface of the intermediate transfer belt 41 by the development part 30M and the primary transfer roller 45M, a magenta developer image is formed. Next, since the cyan developer is transferred onto the surface of the intermediate transfer belt 41 by the development part 30C and the primary transfer roller 45C, a cyan developer image is formed. Next, since the black developer is transferred onto the surface of the intermediate transfer belt 41 by the development part 30K and the primary transfer roller 45K, a black developer image is formed.

Of course, whether or not the development process and the transfer process are actually performed in each of the development parts 30Y, 30M, 30C, and 30K and the primary transfer rollers 45Y, 45M, 45C, and 45K will be determined according to the color required to form an image (the type and the combinations of the developers).

[Secondary Transfer Process]

The medium M carried along the carrying path R1 passes between the backup roller 44 and the secondary transfer roller 46.

In the secondary transfer process, a voltage is applied to the secondary transfer roller 46. Since the secondary transfer roller 46 is contacted and pressed to the backup roller 44 via the medium M, the developer transferred to the intermediate transfer belt 41 in the aforementioned primary transfer process is transferred to the medium M.

[Fusing Process]

After the developer is transferred to the medium M in the secondary transfer process, the medium M is put into the fuser 50 since it is continuously carried in the direction of the arrow F1 along the carrying path R1.

In the fusing process, the surface temperature of the heat application roller 51 is controlled to be a predetermined temperature. When the pressure application roller 52 rotates while being contacted and pressed to the heat application roller 51, the medium M is carried so as to pass between the heat application roller 51 and the pressure application roller 52.

With this, since the developer transferred on the surface of the medium M is heated, the developer melts. Furthermore, since the developer in the melted condition is contacted and pressed to the medium M, the developer strongly adheres to the medium M. Therefore, an image is formed on the surface of the medium M.

Since the medium M in which an image is formed is carried by the carrying roller 63 along the carrying path R2 in the direction of the arrow F2, it is sent out to the stacker part 2.

Further, although it is not described in detail here, the carrying procedure of the medium M is changed according to the pattern of the image to be formed on the surface of the medium M.

For example, when an image is formed on both sides of the medium M, the medium M that passed the fuser 50 is carried in the directions of the arrows F3 and F4 along the carrying paths R3 to R5 by the carrying rollers 64 to 67, and then again carried in the direction of the arrow F1 by the carrying rollers 61 and 62 along the carrying path R1. In this case, the direction in which the medium M is carried is controlled by the carrying path switching guides 71 and 72. With this, on the back side of the medium M (surface in which an image is not yet formed), the development process, the primary transfer process, the secondary transfer process, and the fusing process are performed again.

In addition, for example, when an image is formed on one side of the medium M multiple times, the medium M that passed the fuser 50 is carried in the direction of the arrows F3 and F4 by the carrying rollers 64 to 66 along the carrying paths R3 and R5, and then again carried in the direction of the arrow F1 by the carrying rollers 61 and 62 along the carrying path R1. In this case, the direction in which the medium M is carried is controlled by the carrying path switching guide 71 and 72. With this, on the surface of the medium M (surface in which an image is already formed), the development process, the primary transfer process, the secondary transfer process, and the fusing process are performed again.

[Cleaning Process]

In this image forming apparatus, a cleaning process is performed at an arbitrary timing.

In the development part 30Y, there are cases in which unnecessary developers remain on the surface of the photosensitive drum 31. The unnecessary developers are, for example, a part of the developer used in the primary transfer process, and developer that was not transferred onto the intermediate transfer belt 41 and remained on the surface of the photosensitive drum 31.

Therefore, in the development part 30Y, since the photosensitive drum 31 rotates in a state in which it is contacted and pressed to the cleaning blade 36, the developer remaining on the surface of the photosensitive drum 31 is scraped off by the cleaning blade 36. With this, the unnecessary developer is removed from the surface of the photosensitive drum 31.

Further, the cleaning process using the aforementioned cleaning blade 36 is performed similarly in the development parts 30G, 30C, and 30K.

Furthermore, in the transfer part 40, there are cases in which a portion of the developer that was transferred to the surface of the intermediate transfer belt 41 in the primary transfer process is not transferred onto the surface of the medium M in the secondary transfer process and remains on the surface of the intermediate transfer belt 41.

Therefore, in the transfer part 40, when the intermediate transfer belt 41 moves in the direction of the arrow F5, the developer remaining on the surface of the intermediate transfer belt 41 is scraped off by the cleaning blade 47. With this, the unnecessary developer is removed from the surface of the intermediate transfer belt 41.

<1-5. Functions and Effects>

In this image forming apparatus, since the peeling rate of the external additive 102 relating to the developer 100 is 30.6% or lower, as described above, the external additives 102 are unlikely to be peeled off from the mother particle 101 even when the image formation steps are repeated. Therefore, since the scraping phenomenon is unlikely to occur, a high quality image can be obtained. In this case, when the peeling rate is 25.6% or lower, an even better effect can be obtained.

In particular, when a part or an entirety of the plurality of particulate external additives 102 is entered inside the mother particle 101, since the external additive 102 is strongly fused to the mother particle 101, the peeling rate can be easily and stably set to satisfy the aforementioned conditions.

Further, when the average circularity degree of the plurality of particulate developer 100 is 0.955 to 0.970, even better effects can be obtained since the transferability, etc., of the developer 100 improves.

In the application, the circularity degrees of the developer was measured under the following conditions.

The measuring instrument was FPIA-3000S (manufactured by SYSMEX Corporation). As a preparation for the measurement, 150 mg of toner was placed in a beaker, and a dispersing agent solution was added thereto to make the solution a volume of 15 ml. Thereafter, dispersion treatment was performed while applying ultrasonic waves (100 W) for 2 minutes.

The lens magnification was 20 times, the measurement mode was HPF, the imaging magnification was 40 times, the appropriate measurement range was 0.8 to 20 μm, and the particle sheath (aqueous system) was used as the sheath liquid. The measurement was performed with a valid analyzing number of 1000 pieces.

The method of measuring the circularity degrees is not necessary limited to the above. Other known methods are available to determine the circularity or another feature of the particles.

Furthermore, when the developer 100 includes a crystalline polyester as a binding agent, the developer 100 is more easily fused to the medium M and since the durability of the developer 100 further improves, even better effects can be obtained.

Here, the significance of obtaining the aforementioned functions and effects are as described hereinafter in detail.

The average circularity degree of the developer affects the quality of the image. Specifically, when the average circularity degree of the developer is high, the quality of the image improves since the transfer properties of the developer improve.

As the manufacturing method of the developer, as described above, although a pulverization method, a polymerization method, etc., are used, in view of the increase of the image forming speed, adaptability to a variety of types of mediums, costs, etc., a pulverization method tends to be used. That is because, by using a polyester resin having high affinity to mediums such as paper as a binding agent, the fusing property of the developer to the medium can be easily improved. Further, it is easy to add a charge control agent, etc., to the developer.

However, the average circularity degree of the developers manufactured by a pulverization method tends to be lower in comparison to the average circularity degree of the developers manufactured by the polymerization method. Therefore, when the developers manufactured by a pulverization method are used, there are problems such as difficulty in corresponding to the high definition of images and improving the transfer properties of the developer.

To improve the problem relating to the average circularity degree, for example, it is considered to subject the developer manufactured by a pulverization method to post-processing to thereby improve the average circularity degree of the developer afterwards. However, when the average circularity degree of the developer is improved afterwards, the surface area of the developer decreases. With this, since the charge amount held on the surface of the developer decreases and the friction condition (frequency of occurrences of the frictional force and friction) of the developer decreases, the quality of the images may deteriorate. This tendency is particularly notable when using a single component development system developer.

To improve the deterioration of the image quality, for example, it is considered to intentionally decrease the fluidity of the developer by decreasing the amount of the external additives included in the developers. However, when the fluidity of the developers is decreased, the charge amount held on the surfaces of the developers increases and the friction condition of the developer is improved, but it becomes difficult to supply the developers to the development roller 33 from the supply roller 34 in the development part 30. With this, when an image is formed using the image forming apparatus, the printing density (shade) varies unintentionally in the image, and a so-called scraping phenomenon occurs.

The tendency for occurrence of scraping phenomenon becomes notable particularly when the fluidity of the developers decreases because of the increase in the peeling amount of the external additives when the image forming steps are repeated. Further, the tendency to occur the scraping phenomenon becomes notable when forming a solid image (print duty=100%) since the tendency becomes likely to occur as the amount of the developers supplied to the photosensitive drum 31 from the development roller 33 increases.

Therefore, when using the developer including external additives, since the improvement of the average circularity degree of the developers and the suppression of occurrence of the scraping phenomenon has a trade-off relationship, it is difficult to obtain a high quality image. That is, when the average circularity degree of the developers is improved, the scraping phenomenon easily occurs and it becomes hard to obtain a high quality image. On the other hand, when occurrence of scraping phenomenon is suppressed, since the average circularity degree of the developers has to be lowered, it becomes hard to obtain a high quality image because of the decrease of the average circularity degree of the developers.

On the other hand, in the image forming apparatus of the present invention, as described above, by setting the peeling rate of the external additive 102 relating to the developer 100 to 30.6% or less, the average circularity degree of the developer 100 can be high while the occurrences of the scraping phenomenon can be suppressed. Therefore, since the aforementioned trade-off relationship can be broken, a high quality image can be obtained.

2. Modified Example

In FIG. 1, four development parts 30 (30Y, 30M, 30C, and 30K) corresponding to the four types of colors (yellow, magenta, cyan, and black) are used, but the number of the development parts 30 is not especially limited. The number of the development part 30 can be arbitrarily set according to the conditions, such as the number of colors used when forming an image.

Further, the developer 100 including the external additives 102 (102A to 102C), as described above, may be applied to a part (one type, two types, or three types) or all of the four types of developers (yellow developer, magenta developer, cyan developer, and black developer). In this case, similar effects can be obtained. However, to improve the quality of an image as much as possible, it is preferable that the developers 100 be applied to all four types of developers.

EXAMPLES

The examples of the present invention will be described in detail. Further, the order of descriptions is as follows:

1. Manufacturing the developer
2. Physical properties of the developer
3. Evaluation of the image formed using the developer <1. Manufacturing the Developer>

5 types of developers S1 to S5 were manufactured using a pulverization method to obtain a black developer according to the procedures described hereinafter.

Initially, a mixture was obtained by mixing a coloring agent (carbon black), a binding agent (crystalline polyester), a release agent (polyolefin wax), and a charge control agent (salicylate base complex). The mixing ratio was set to 5 parts by weight of a coloring agent, 3 parts by weight of a release agent, and 0.3 parts by weight of a charge control agent to 100 parts by weight of a binding agent.

Next, after melt-kneading the mixture using an extruder, a precursor was obtained by cooling the melt-kneaded mixture.

Next, the precursor was coarsely grinded using a cutter mill and after the precursor was continuously finely grinded using a jet mill, the precursor after fine grinding was classified using an air-classifier to obtain a mother particle. When coarsely or finely grinding the precursor, to perform a pre-external addition process, external additives were added to the precursor. As the external additives, a mixture of a hydrophobic silica (R972 manufactured by Japan Aerosil Corporation: mean particle diameter (D50)=16 nm) and melamine resin particles (EPOSTERs manufactured by Nippon Shokubai Co., Ltd., mean particle diameter (D50)=0.2 μm) was used. The addition amount of the external additive (pre-external addition amount: %) is as shown in Table 1. Further, as an example, a pre-external addition amount of "40%" means a weight corresponding to 40% of the total weight (100%) of the external additives ultimately included in the developer.

Finally, to perform a post-external addition process, after external additives were added to the mother particles, the mother particles and the external additives were mixed and stirred using a Henschel mixer. The type of the external additives added in the post-external addition process is the same as the type of external additives added in the pre-external addition process. The addition amount of the external additives (post-external addition amount: %) is as shown in Table 1. Further, as an example, a post-external addition amount of "60%" means a weight corresponding to 60% of the total weight (100%) of the external additives ultimately included in the developer.

The total addition amount of the external additives, that is, the sum of the pre-external addition amount and the post-external addition amount, was set so that there was 4 parts by weight of hydrophobic silica and 0.3 parts by weight of melamine resin particles to 100 parts by weight of the mother particles.

With this, the developers S1 to S5 were obtained. The developers S1 to S5 were negatively chargeable developers. Further, the average circularity degree of the developers S1 to S5 was 0.960.

<2. Physical Properties of Developer>

The peeling rate (%) of the developers S1 to S5 were examined using the procedure described hereinafter. Further, hereinafter, a case in which the physical properties of the developer S1 were examined will be exemplified and described. The procedures in which their physical properties of the developers S2 to S5 were examined were the same as the procedures to examine the physical properties of the developer S1.

Initially, using an energy dispersive X-ray fluorescence spectrometer (EDX-800HS manufactured by Shimadzu Corporation), the amount of the external additives contained (included) in the developer S1 (external additive amount before applying ultrasonic waves: weight %) was measured.

Next, after introducing 5 parts by weight of the developer S1 to 100 parts by weight of the PLE solution and stirring the PLE solution, the developer S1 was dispersed in the PLE solution. In this case, EMULGEN 109P manufactured by Kao Corporation was used as the PLE solution and the stirring time was set to three hours. The conditions relating to the PLE solution was set to: density=5% and temperature=32° C.

Next, ultrasonic waves were applied to the PLE solution in which the developer S1 was dispersed. To apply ultrasonic waves to the PLE solution, an ultrasonic cleaner (USCLEANER US-2R manufactured by AS one Corporation) was used. The application condition of ultrasonic waves was set to: strength=40 kHz, and time=10 minutes. After applying the ultrasonic waves, the PLE solution was filtered using pure water or a filter paper (thickness=100 mm) and then the residue (the developer S1 after applying the ultrasonic wave) was dried.

Next, with the same procedures in the aforementioned case in which the external additive amount before the application of the ultrasonic waves was examined, the amount of the external additives contained (included) in the residue (developer S1) (external additive amount after applying ultrasonic waves: weight %) was measured.

Finally, the peeling rate (%) of the external additive was calculated based on the aforementioned formula (1). When calculating the peeling rate, the external additive amount (weight %) after applying the ultrasonic waves was set to X and the external additive amount (weight %) before applying the ultrasonic waves was set to Y.

The peeling rates calculated for each of the developers S1 to S5 are shown in Table 1.

Further, since the developers S1 to S5 included a common binding agent (crystalline polyester), the common thermophysical properties were shown. Specifically, each of the glass-transition temperatures Tg of the developers S1 to S5 was all 60.8° C. Furthermore, when the developers S1 to S5 were continuously analyzed twice using a differential scanning calorimeter (EXSTAR600 manufactured by Seiko Instruments Inc.), a weak endothermic peak was detected in a range of 30° C. to 70° C. at the time of first melting, but an endothermic peak was not detected in a range of 30° C. to 70° C. at the time of second melting (at the time of melting again after cooling).

TABLE 1

| Developer | Pre-External Addition Amount (%) | Post-External Addition Amount (%) | External Addition Amount (wt %) Before App. | After App. | Peeling Rate (%) |
|---|---|---|---|---|---|
| S1 | 40 | 60 | 3.6 | 2.3 | 36.1 |
| S2 | 60 | 40 | 3.6 | 2.5 | 30.6 |
| S3 | 70 | 30 | 3.9 | 2.9 | 25.6 |
| S4 | 80 | 20 | 3.9 | 3.0 | 23.1 |
| S5 | 90 | 10 | 3.9 | 3.1 | 20.5 |

Evaluation of Image Formed Using Developer

Examples 1 to 5

An image was formed using each of the developers S1 to S5 according to the procedures described below, and the image was evaluated. In the following description, an example in which an image was evaluated using the developer S1 will be described. The procedures for evaluating the image using each of the developers S2 to S5 were the same as the procedures for evaluating the image using the developer S1.

After introducing developer S1 into the cartridge of a development part, an image was formed using an image forming apparatus equipped with the development part. As an image forming apparatus, a color printer c711dn manufactured by Oki Data Corporation was used, and as a medium on which an image was formed, a color printer paper, Excellent White A4, made by Oki Data Corporation, was used. The type of the image was a solid image (print duty=0.3%). This image was an image in which horizontal band lines was printed by the number corresponding to 0.3% when the number of horizontal band lines to be printed in a normal solid image was 100%. The reason why the print condition (print duty value) was set to be an extremely small value (0.3%) was that in order to perform an experiment with the purpose of deliberately damaging the developer S1, it was intended to reduce the consumption of the developer S1 as much as possible.

When forming images, images were continuously formed for 6 days under the following environmental conditions. In this case, images were formed one by one in 10 seconds and the number of times of image formation per day was set to 3,000 times.

$1^{st}$ day, $2^{nd}$ day: temperature=24° C., humidity=50%

$3^{rd}$ day, $4^{th}$ day: temperature=28° C., humidity=80%

$5^{th}$ day, $6^{th}$ day: temperature=10° C., humidity=20%

When forming images, due to, e.g., the friction between the development blade and the developer S1, the developer S1 was negatively charged. The negative charge amount of the developer S1 was −25 μC/g. In addition, each of the developers S2 to S5 was negatively charged, and the negative charge amount of each of the developers S2 to S5 was the same as the charge amount of the developer S1.

The occurrence of rubbing phenomenon was evaluated while continuously forming images for 6 days, and the results shown in Table 2 were obtained.

The image used for the evaluation was an image formed at the $3{,}000^{th}$ time on each of the $1^{st}$ day to the $6^{th}$ day. In the case of checking the occurrence of rubbing, the case in which the rubbing phenomenon did not occur at all was judged as "A". The case in which the rubbing phenomenon occurred slightly, but the rubbing phenomenon was not a problem in actual use was judged as "B". The case in which the rubbing phenomenon occurred, but it was acceptable for practical use was judged as "C". The case in which a rubbing phenomenon occurred and the rubbing phenomenon caused a problem in practical use was judged as "D".

TABLE 2

| Examples | Developer | Peeling Rate (%) | Evaluation Result 1 Day | 2 Day | 3 Day | 4 Day | 5 Day | 6 Day |
|---|---|---|---|---|---|---|---|---|
| 1 | S1 | 36.1 | B | D | D | D | A | D |
| 2 | S2 | 30.6 | A | B | C | C | A | B |
| 3 | S3 | 25.6 | A | B | B | B | A | B |
| 4 | S4 | 23.1 | A | A | B | B | A | B |
| 5 | S5 | 20.5 | A | A | A | A | A | A |

Environmental Conditions:
1st day, 2nd day: Temp. = 24 C°, Humidity = 50%
3rd day, 4th day: Temp. = 28 C°, Humidity = 80%
5rd day, 6th day: Temp. = 10 C°, Humidity = 20%

The occurrence of rubbing phenomenon greatly varied depending on the peeling rate.

Specifically, since the developer S1 was used, when the peeling rate was greater than 30.6% (Example 1), a severe rubbing phenomenon occurred which was problematic in practical use.

On the other hand, since the developers S2 to S5 were used, when the peeling rate was 30.6% or less (Examples 2 to 5), the occurrence of rubbing phenomenon was suppressed to the extent that there was no problem in practical use. In this case, in particular, when the peeling rate was 25.6% or less (Examples 3 to 5), preferably the peeling rate was 23.1% or less (Examples 4 and 5), the occurrence of rubbing phenomenon was more suppressed. Furthermore, when the peeling rate was 20.5% or less (Example 5), the rubbing phenomenon did not occur.

Focusing on the relationship between the environmental conditions and the occurrence state of the rubbing phenomenon, the occurrence state of the rubbing phenomenon particularly showed to be likely to deteriorate on the $3^{rd}$ day and the $4^{th}$ day when it was in high temperature and high humidity condition (temperature=28° C., humidity=80%). The reason for this is considered that the flowability of the developer tends to deteriorate under the conditions of high temperature and high humidity, which causes deterioration of the fusing property of the developer to the media.

Conversely speaking, when the peeling rate is 30.6% or less, even when an image is formed under high temperature and high humidity conditions, the rubbing phenomenon hardly occurs, so that it becomes easy to form a high quality image.

From these facts, when developer including an external additive is used, when the peeling rate of the external additive relating to the developer is 30.6% or less, an occurrence of rubbing phenomenon is suppressed. Therefore, it was possible to obtain a high quality image.

Although the present invention has been described with reference to one embodiment, the present invention is not limited to the embodiment described in the above embodiment, and various modifications can be made. For example, the image forming system of the image forming apparatus according to an embodiment of the present invention is not limited to the intermediate transfer method using an intermediate transfer belt, but other image forming methods may be used. Further, the image forming apparatus according to an embodiment of the present invention is not limited to a full-color printer, but may be a monochrome (monochrome) printer.

With respect to the term, "circularity degree," a mean value as well as the average value may be available as long as these values properly represent a feature of the particles. In the same fashion, with respect to the term, "particular diameter, an average value as well as the mean value may be available as long as the values properly represent a feature of the particles.

What is claimed:

1. A method for forming a developer composed with a plurality of mother particles containing a coloring agent and an external additive by:

fusing a first group of external additive particles of the external additive on and at least partially inside mother particles during a pre-external addition process in which the first group of external additive particles is added to a precursor of the developer before pulverization of the precursor, the first group of external additive particles of the external additive being 60% or more of a total amount of the external additive particles of the external additive added; and fusing a second group of external additive particles of the external additive on the mother particles during a post-external addition process in which the mother particles are stirred with the second group of external additive particles after the pulverization of the precursor, the second group of external additive particles of the external additive being 40% or less of the total amount of the external additive particles of the external additive added, wherein an average circularity degree of the developer is ranged within 0.955 to 0.970, and the developer thus formed is configured to have a peeling rate (%) of the external additive calculated by a following formula (1) is 30.6% or less, being calculated when ultrasonic waves are applied to a polyoxyethylene lauryl ether solution in which the developer is dispersed, $$\text{peeling rate (\%)}=[1-(X/Y)]\times 100 \quad (1)$$

wherein X is an amount (weight %) of the external additive included in the developer after the ultrasonic waves are applied, Y is an amount (weight %) of the external additive included in the developer before the ultrasonic waves are applied, the polyoxyethylene lauryl ether solution is set such that a density=5% and a temperature=32° C., and the application of the ultrasonic waves is set such that strength=40 kHz and time=10 minutes.

2. The method according to claim 1, wherein the peeling rate of the external additive is 25.6% or less.

3. The method according to claim 1, wherein a mean particle diameter of the external additive is smaller than a mean particle diameter of the mother particles.

4. The method according to claim 1, wherein the developer further includes a binding agent in which a crystalline polyester is contained.

5. The method according to claim 1, wherein the developer is single component development system developer.

6. The method according to claim 1, wherein the developer is negatively chargeable developer.

7. The method according to claim 1, wherein a saturated charge amount of the developer is ranged within −50 μC/g to −10 μC/g.

* * * * *